US008020861B2

(12) United States Patent
Itabashi et al.

(10) Patent No.: US 8,020,861 B2
(45) Date of Patent: Sep. 20, 2011

(54) SHEET CONVEYANCE DEVICE AND IMAGE FORMING APPARATUS

(75) Inventors: Toshifumi Itabashi, Toride (JP); Yusuke Imai, Toride (JP); Kiyoshi Oyama, Tokyo (JP); Takuma Koizumi, Toride (JP); Ayumu Murakami, Abiko (JP); Yuichi Yamamoto, Toride (JP); Haruhisa Oshida, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 1013 days.

(21) Appl. No.: 11/833,349

(22) Filed: Aug. 3, 2007

(65) Prior Publication Data

US 2008/0030809 A1 Feb. 7, 2008

(30) Foreign Application Priority Data

Aug. 7, 2006 (JP) ..... 2006-214665

(51) Int. Cl.
*B65H 7/02* (2006.01)

(52) U.S. Cl. ..... 271/258.01; 271/261; 271/265.01; 358/498

(58) Field of Classification Search ..... 271/258.01, 271/261, 265.01, 265.03; 358/498
See application file for complete search history.

(56) References Cited

U.S. PATENT DOCUMENTS

| | | | | |
|---|---|---|---|---|
| 6,757,515 | B2 | 6/2004 | Ueda | 399/396 |
| 7,787,161 | B2 * | 8/2010 | Oyama | 358/498 |
| 2005/0206069 | A1 | 9/2005 | Yamamoto | 271/117 |
| 2006/0220305 | A1 | 10/2006 | Serizawa et al. | 271/262 |
| 2007/0273083 | A1 | 11/2007 | Imai | 271/152 |

FOREIGN PATENT DOCUMENTS

| | | |
|---|---|---|
| JP | 2002-347976 | 12/2002 |
| JP | 2005-335897 | 12/2005 |

* cited by examiner

*Primary Examiner* — David H Bollinger
(74) *Attorney, Agent, or Firm* — Fitzpatrick, Cella, Harper & Scinto

(57) ABSTRACT

A sheet conveyance device according to an aspect of the invention includes a conveyance roller pair which is rotated to convey a sheet by receiving a driving force from a motor conveying a sheet; a conveyance guide which guides the sheet conveyed by the conveyance roller pair; and sheet detection unit for detecting the sheet guided by the conveyance guide. In the sheet conveyance device, a sheet conveyance speed of the conveyance roller pair is controlled based on information from the sheet detection unit. The sheet detection unit is a sheet scanner having an optical sensor layer in which photo-electric conversion devices formed by combinations of organic transistors and organic photodiodes are continuously arranged in a matrix shape, and the sheet scanner is provided in an area of the conveyance guide in order to continuously detect the sheet conveyed by the conveyance roller pair in a predetermined area.

4 Claims, 12 Drawing Sheets

SHEET CONVEYANCE DEVICE AND IMAGE FORMING APPARATUS

BACKGROUND OF THE INVENTION

1. Field of the Invention

The present invention relates to a sheet conveyance device for conveying a sheet and an image forming apparatus provided with the sheet conveyance device.

2. Description of the Related Art

Conventionally, in an image forming apparatus such as a copying machine in which an electrophotographic system is used, a sheet such as recording paper in which an image is recorded is conveyed along a guide by rotation of a roller pair while nipped between the roller pair. The roller pairs which convey the sheet are arranged at an interval shorter than a length of the sheet in a conveyance direction, and the roller pair is rotated by a driving device such as a motor. A sheet conveyance speed of the sheet conveyed by the roller rotated by the motor controlled if necessary in such cases as the time recording is performed in the sheet, the time the sheet is fed from a sheet storage portion, and the time the sheet in which the recording is already performed is discharged. The sheet conveyance speed of the roller is increased, decreased or the roller is stopped in order to correct an attitude (such as skew and shift) of the sheet during the conveyance or to bring intervals between the sheets close to a predetermined setting value during the continuous conveyance.

The sheet conveyance control is performed based on detection information from a sheet detection sensor provided on a conveyance path. The sheet detection sensor detects a position of the sheet conveyed along the guide constituting the conveyance path. Examples of the sheet detection sensor include a flag sensor type and a photo sensor type. The sheet detection sensor provided on the conveyance path determines the position of the sheet by detecting passage of a leading end or a rear end of the sheet. When the sheet cannot be detected at predetermined conveyance timing, it is determined that conveyance failure such as jamming is generated (for example, see Japanese Patent Application Laid-Open No. 2002-347976)

As described above, the sheet detection sensor used in the sheet conveyance control is formed by the flag sensor type or the photo sensor type. Therefore from the standpoint of structure, it is difficult that the many sensors are continuously arranged in the conveyance path between the rollers. That is, in the flag sensor or the photo sensor, only one or two sensors are provided in the conveyance path between the rollers while separated away from each other due to the structure of the sensor, and the sheet is intermittently detected by the sensor. Particularly, in the case of downsizing the image forming apparatus, because the conveyance path is shortened or curved, sometimes the sensor cannot be provided depending on the conveyance path, and the arrangement of the sensor is further restricted. Thus, in the conventional configuration, because the detection point of the sensor is restricted, a status of the sheet cannot be traced except for the detection point, and it is difficult to finely perform the sheet conveyance control.

For example, it is assumed that, in order to bring an interval between the two continuous sheets close to a setting value, the sheet conveyance speed of the roller is increased or decreased based on information from the sensor located immediately after the roller for conveying the subsequent sheet. In this case, because the sheet detection sensors can intermittently be provided as described above, it cannot be determined whether or not the sheet interval is brought close to the setting value until the sheet passing by the sensor reaches the next sensor. Therefore, it is difficult to finely perform the sheet conveyance control.

In the conventional sheet conveyance control, it is necessary to perform the sheet conveyance control in consideration of the following fluctuations. Examples of a main generation factor of the fluctuation include conveyance delay caused by slip between the roller and the sheet, delay of a control signal from a controller to a motor or a clutch, a rising of falling shift of the motor, a shift of operation response, and shift of a stop position caused by an inertia force in stopping the conveyance. The fluctuations are indeterminately generated depending on the status of the conveyed sheet, environmental variations such as temperature and humidity, and simultaneously processed control contents Therefore, it is necessary that the sheet interval be set while a margin is ensured to permit the fluctuations, which results in a problem of decreasing productivity by the margin.

SUMMARY OF THE INVENTION

In view of the foregoing, the present invention continuously provides a sheet conveyance device and image forming apparatus to detect the position of the conveyed sheet at any time or in a predetermined area to perform the finer sheet conveyance control.

In order to achieve the object, a sheet conveyance device according to an aspect of the invention includes a sheet conveyance member which conveys a sheet; a guide member which guides the sheet conveyed by the sheet conveyance member; and sheet detection unit which detects the sheet guided by the guide member, wherein a sheet conveyance speed of the sheet conveyed by the sheet conveyance member is controls based on information from the sheet detection unit, wherein the sheet detection unit is a sheet scanner having an optical sensor layer in which photoelectric conversion devices formed by combinations of organic transistors and organic photodiodes are continuously arranged in a matrix shape, and the sheet scanner is provided in the guide member in order to continuously detect the sheet conveyed by the sheet conveyance member.

BRIEF DESCRIPTION OF THE DRAWINGS

FIG. 11 is a view illustrating a sheet scanner in which photoelectric conversion devices formed by combinations of organic semiconductor devices are continuously arranged, in which

DESCRIPTION OF THE EMBODIMENTS

Exemplary embodiments of the invention will be described in detail below with reference to the accompanying drawings. However, sizes, materials, and shapes of component and a relative arrangement of components described in the following embodiments should appropriately be changed according to a configuration and various conditions of an apparatus to which the invention is applied. Accordingly, the scope of the invention is not limited to the embodiments unless particularly stated.

First a sheet-shape scanner (hereinafter referred to as sheet scanner) which is used as sheet detection unit for detecting a sheet in the following embodiment will be described.

Recently, there has been proposed the sheet scanner in which an organic semiconductor device is used as a photoelectric conversion device. The sheet scanner has an optical sensor layer in which the photoelectric conversion devices formed by combinations of organic transistors and organic photodiodes are continuously arranged. For example, in the sheet scanner, a reading pixel which is of an optical sensor is formed on a plastic film by the combination of the organic transistor and the organic photodiode, and the reading pixels are arranged in a matrix shape, namely, the reading pixels are arranged in row and column directions. When the reading pixel (optical sensor) is irradiated with light, the organic photodiode generates electric current.

Figure 11A:
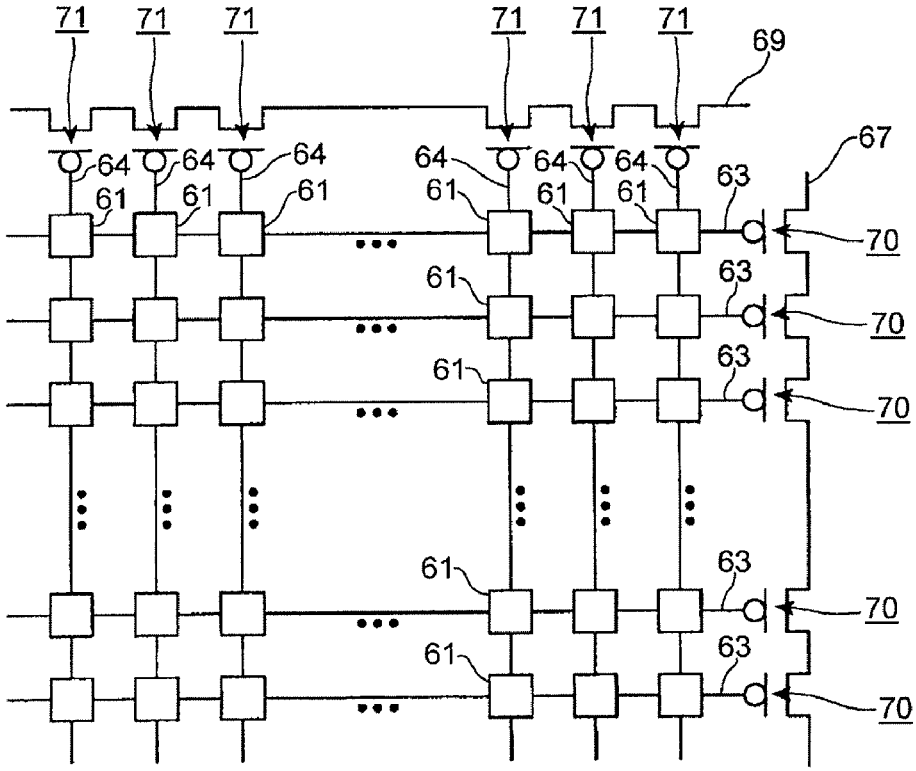
FIG. 11A is a schematic view illustrating a circuit configuration of the sheet scanner.
Figure 11B:
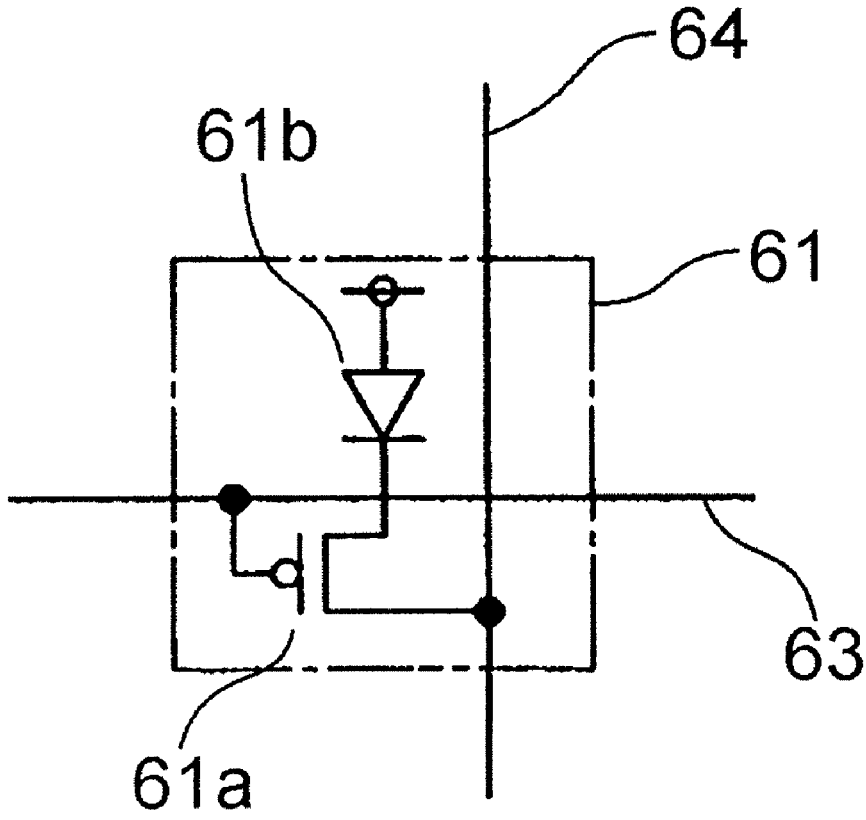
FIG. 11B is a schematic view illustrating a circuit configuration of each photoelectric conversion device.

FIG. 11 illustrates a mode of the sheet scanner. FIG. 11A is a schematic view illustrating a circuit configuration of the sheet scanner in which the optical sensors formed by the organic semiconductor devices are arranged in a matrix shape, and FIG. 11B is a schematic view illustrating a circuit configuration of each optical sensor.

Referring to FIG. 11A, reading pixels 61 arranged in one column line are connected to word lines 63 respectively, and the word lines 63 are connected to a column decode line 67 through word-line selectors 70. The reading pixels 61 arranged in one row line are connected to bit lines 64, and the bit lines 64 are connected to a row decode line 69 through bit-line selectors 71. A current of the predetermined reading pixel 61 is read by specifying addresses of the column decode line 67 and row decode line 69. A position (state) of the sheet located on the sheet scanner can be detected by reading the current of each reading pixel 61. Referring to FIG. 11B, each reading pixel 61 is formed by a combination of an organic transistor 61*a* and an organic photodiode 61*b*.

Because the reading pixel which is of the photoelectric conversion device is formed by organic semiconductor devices such as the organic transistor and the organic photodiode, the reading pixel can directly be disposed on a conveyance guide which is of a later-mentioned guide member by utilizing, e.g., a precise printing technique. Alternatively, the reading pixel and a peripheral circuit thereof are formed on a base-material sheet such as a flexible plastic film, and an elastically bendable flexible sheet scanner may be disposed in the conveyance guide as appropriate. In the reading pixels, the number of lines can be formed arbitrarily and selectively in the row and column directions, so that one-line sensor array can easily be formed in a sheet conveyance direction. Additionally, because the reading pixels can be formed and arranged on the conveyance guide or the base-material sheet, even if a conveyance path is curved, the reading pixels can continuously be disposed along the conveyance path while being able to detect the sheet. The sheet scanner may be configured such that an additional light emitting layer is integrally formed in addition to the optical sensor layer.

Then, the sheet conveyance device in which the sheet scanner is used as the sheet detection unit will be described by way of example. The sheet conveyance device in the image forming apparatus is illustrated in the following embodiments. Although the image forming apparatus is not shown, the description focuses on the image forming apparatus of the electrophotographic system. In the image forming apparatus of the electrophotographic system, a toner image is formed on an image bearing member in an image forming portion. The toner image is transferred to the sheet conveyed by the sheet conveyance device. In the sheet conveyance device, the sheet is delivered one by one by a sheet delivering portion, the sheet on which the toner image is transferred is sent to a fixing device, and the toner image is fixed onto the sheet by heating and pressurization. In the case where the images are formed on both sides of the sheet, the sheet in which the image is formed on one side as described above is delivered to the image forming portion again by a sheet re-delivering portion, and the image is formed in the same manner. Then, the sheet on which the image is formed is discharged onto a sheet stack portion by a sheet discharge portion.

First Embodiment

Figure 1:
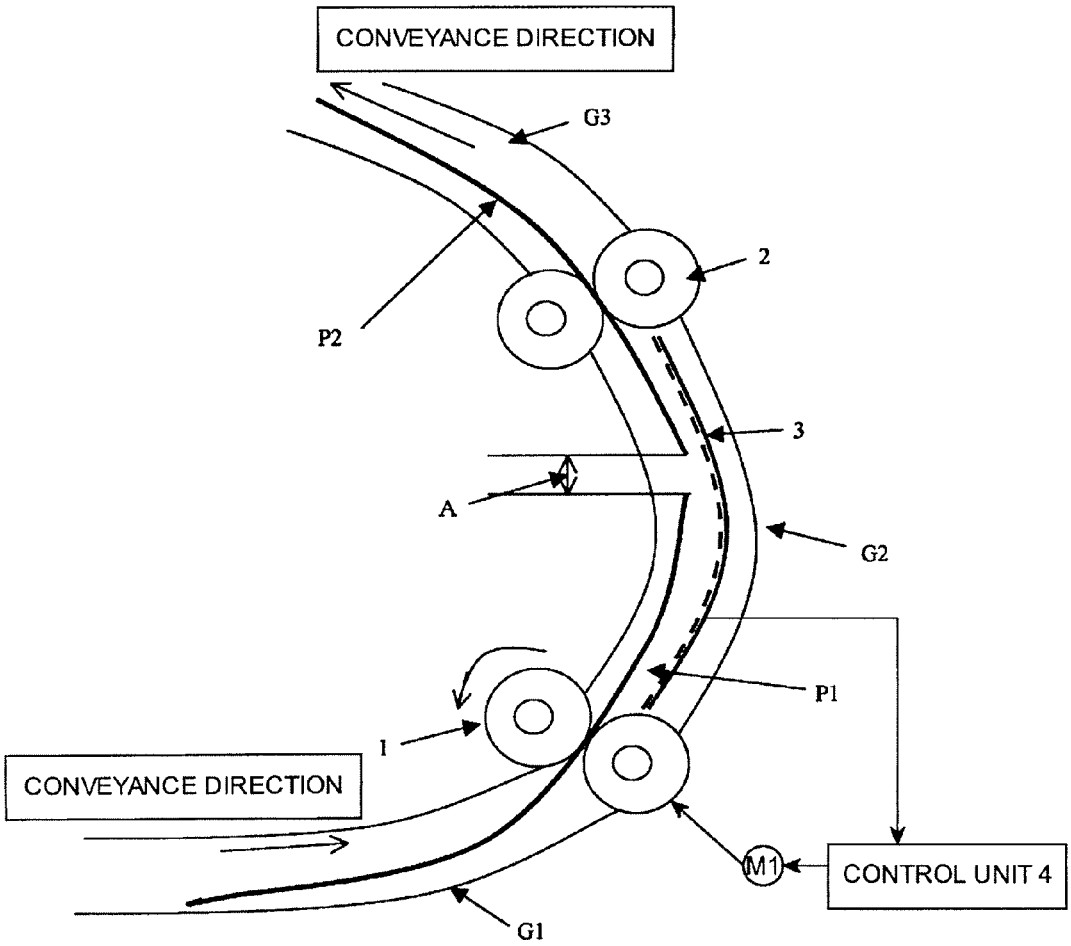
FIG. 1 is a sectional view illustrating a sheet conveyance device according to a first embodiment of the invention.
Figure 2:
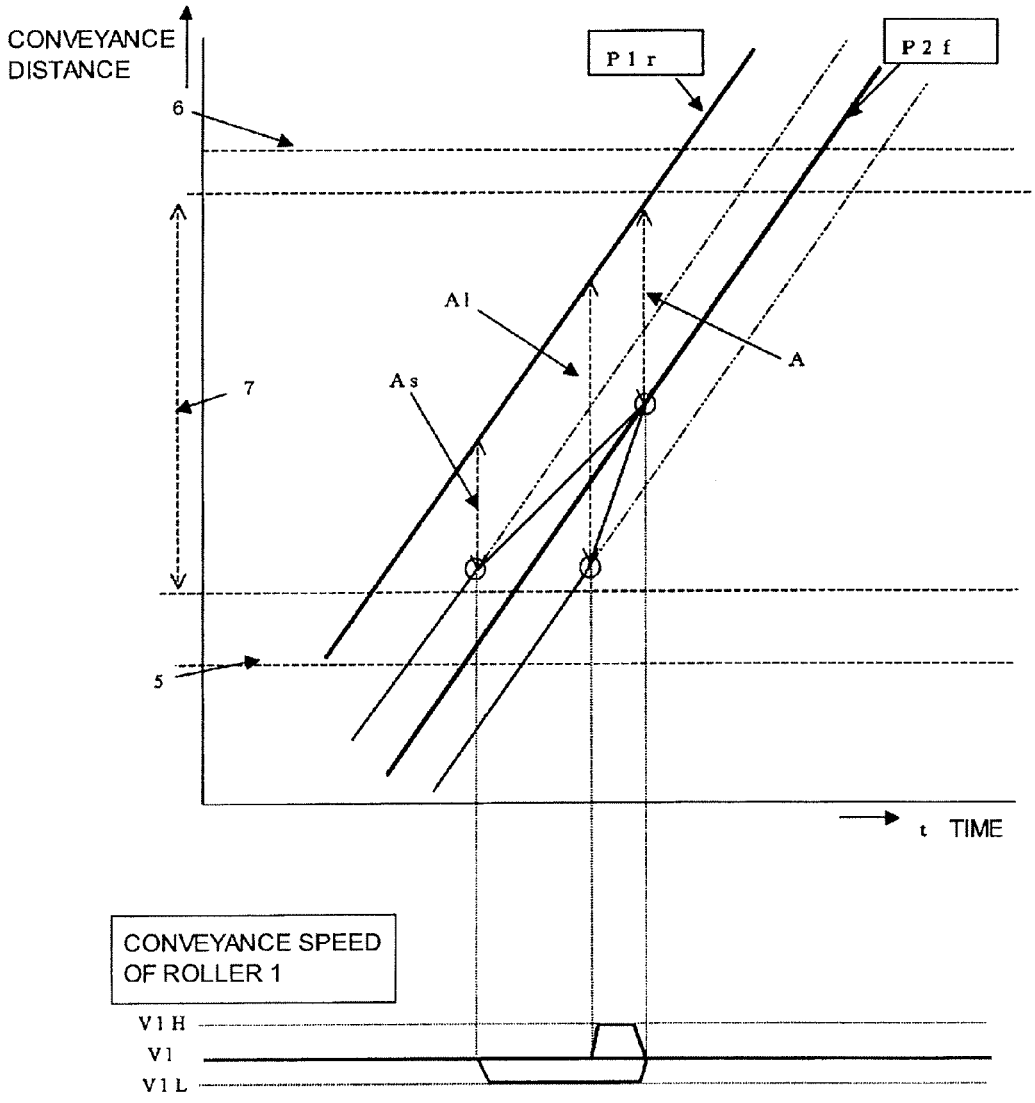
FIG. 2 is a view illustrating sheet conveyance control of the first embodiment.
Figure 3:
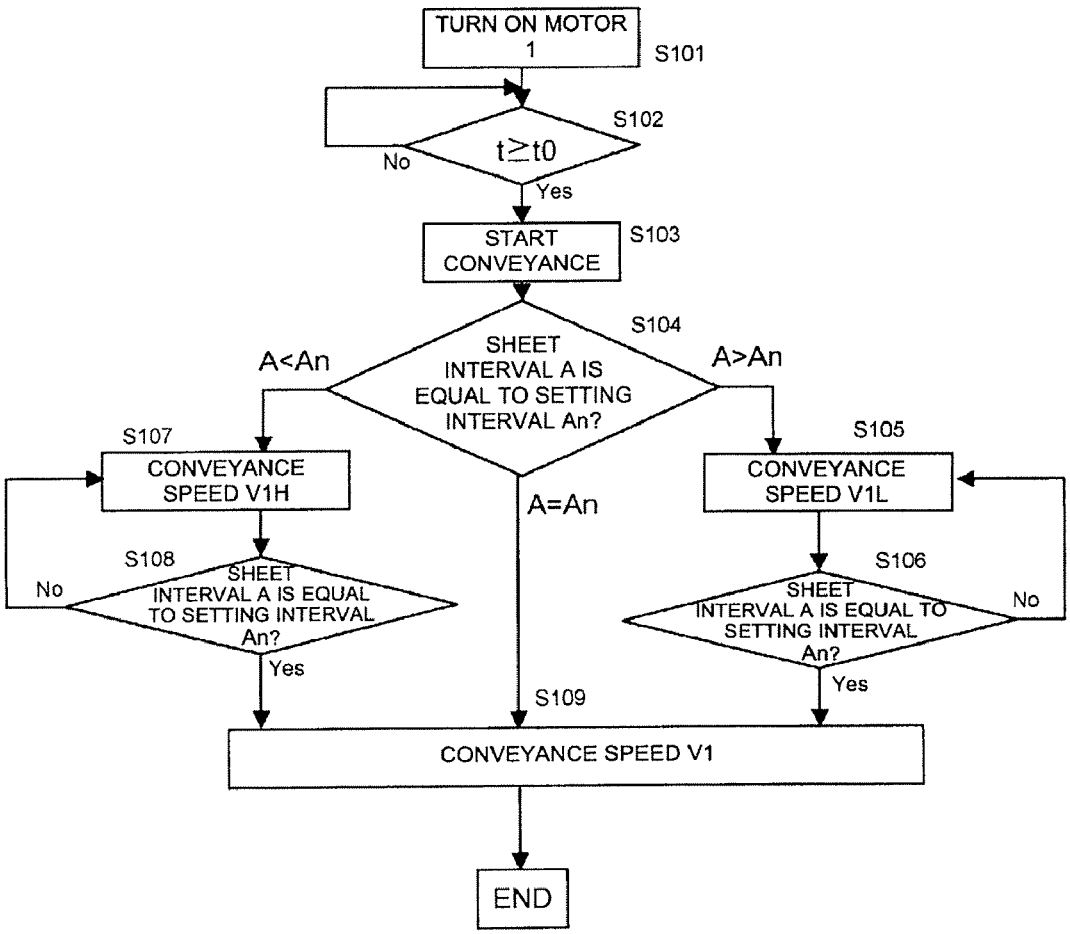
FIG. 3 is a flowchart illustrating control of the sheet conveyance device of the first embodiment.

A sheet conveyance device according to a first embodiment of the invention will be described in detail with reference to FIGS. 1 to 3. FIG. 1 is a sectional view illustrating a schematic configuration of a main part of the sheet conveyance device, FIG. 2 schematically illustrates conveyance control, and FIG. 3 is a flowchart illustrating the conveyance control.

The schematic configuration of the sheet conveyance device will be described with reference to FIG. 1, and then the conveyance control of the sheet conveyance device will be described.

Referring to FIG. 1, the sheet conveyance device includes a conveyance roller pairs 1 and 2 which are of a sheet conveyance member for conveying the sheet. The conveyance roller pair 1 is of a first sheet conveyance member, and the conveyance roller pair 2 which is of a second sheet conveyance member located on a downstream of the conveyance roller pair 1 in the sheet conveyance direction. The conveyance roller pair 1 is rotated by a driving force from a motor M1, and the motor M1 is of a driving source which can increase and decrease a sheet conveyance speed. Control unit 4 controls the drive of the motor M1. The sheet conveyance device also includes conveyance guides G1, G2, and G3 which guide the sheet. The conveyance guides G1, G2, and G3 constitute a conveyance path through which the sheet conveyed by the conveyance roller pairs 1 and 2 is guided. In the first embodiment, the conveyance guides G1, G2, and G3 constitute the curved conveyance path. A flexible sheet scanner 3 which is of the above-described sheet detection unit is provided along a guide surface in the conveyance guide G2 between the conveyance roller pairs 1 and 2, which constitutes a part of the conveyance path. On the basis of information obtained from the sheet scanner 3, the control unit 4 controls the drive of the motor M1, i.e., the sheet conveyance speed of the sheet conveyed by the conveyance roller pair 1.

The sheet detection performed by the sheet scanner will be described by illustrating the case in which the interval between the sheets is detected.

When a subsequent sheet P2 is conveyed by the conveyance roller pair 1 while a preceding sheet P1 is conveyed by the conveyance roller pair 2, a leading-end boundary between a rear-end boundary of the preceding sheet P1 and a leading-end boundary of the subsequent sheet P2 is detected by the sheet scanner 3 on the conveyance path G2. This enables a sheet interval A to be measured between the rear-end boundary of the preceding sheet P1 and the leading-end boundary of the subsequent sheet P2. The sheet scanner 3 can detect the presence or absence of the sheet to detect a leading-end position or a rear-end position of the sheet.

The position of the conveyed sheet can continuously be detected, because the reading pixels 61 which are of the photoelectric conversion device are arranged in the matrix shape in the row direction (sheet conveyance direction) and the column direction (sheet width direction orthogonal to the sheet conveyance direction) in the sheet scanner 3. That is, the sheet scanner 3 can continuously trace the change in position of the conveyed sheet in an area where the sheet scanner 3 is provided. This enables the sheet interval A between the sheets P1 and P2 to be always measured while the sheets P1 and P2 are conveyed in the area where the sheet scanner 3 is provided.

Then, the sheet conveyance control based on the sheet detection information will be described with reference to FIGS. 2 and 3. In FIGS. 2 and 3, a sheet interval An (hereinafter referred to as setting interval) is an interval set according to the conveyance conditions. In FIG. 2, the numeral P1*r* designates a rear-end boundary of the preceding sheet P1 and the numeral P2*f* is a leading-end boundary of the subsequent sheet. The numeral 5 designates a position of the conveyance roller pair 1, the numeral 6 designates a position of the conveyance roller pair 2, and the numeral 7 designates a detection area of the sheet scanner. When the sheets are continuously conveyed, the sheet scanner 3 detects the sheet interval A, and the sheet scanner 3 increases or decreases the sheet conveyance speed of the conveyance roller pair 1 based on the detection result such that the sheet interval A becomes the setting interval An.

In the actual conveyance state (S101 to S103), it is assumed that the sheet scanner 3 determines that the sheet interval A is a sheet interval As which is narrower than the setting interval An (S104). In this case, while the sheet scanner 3 measures the sheet interval A, the sheet scanner 3 decreases the sheet conveyance speed of the conveyance roller pair 1 such that the sheet conveyance speed becomes a conveyance speed V1L which is slower than a usual conveyance speed V1 (S105). Therefore, the sheet interval is widened. When the sheet interval A becomes the setting interval An (S106), the sheet conveyance speed of the conveyance roller pair 1 is returned to the usual conveyance speed V1 (S109), and the sheet interval A is kept at the setting interval An.

On the other hand, in the actual conveyance state (S101 to S103), it is assumed that the sheet scanner 3 determines that the sheet interval A is a sheet interval A1 which is wider than the setting interval An (S104). In this case, while the sheet scanner 3 measures the sheet interval A, the sheet scanner 3 increases the sheet conveyance speed of the conveyance roller pair 1 such that the sheet conveyance speed becomes a conveyance speed V1H which is faster than the usual conveyance speed V1 (S107). Therefore, the sheet interval is narrowed. When the sheet interval A becomes the setting interval An (S108), the sheet conveyance speed of the conveyance roller pair 1 is returned to the usual conveyance speed V1 (S109), and the sheet interval A is kept at the setting interval An.

As described above, when the sheet interval A is not brought close to the setting interval An even if the sheet conveyance speed of the conveyance roller pair 1 is increased or decreased, the control unit 4 determines that conveyance failure is occurred.

Thus, according to the first embodiment, because the sheet scanner 3 in which the reading pixels 61 are arranged in the matrix shape is used as the sheet detection unit, the conveyed sheet can continuously be detected in the conveyance guide G2. The sheet scanner 3 is provided in the conveyance guide G2 which constitutes a part of the conveyance path. Accordingly, the sheet conveyance control is performed more finely based on the detection information. Because the sheet conveyance control is performed while the conveyed sheet is continuously detected, the need to set the sheet interval in which the margin is ensured to permit the fluctuation can be eliminated to decrease the sheet interval, which improves the productivity. Because the sheet scanner requires the small installation space, the above effects can be obtained without enlarging the apparatus.

It is not always necessary to keep the conveyance speeds V1L and V1H at constant conveyance speeds. The setting interval An is the single setting value in the first embodiment. However, the setting interval An is not limited to the single setting value, but the setting interval An may have a certain range.

The conveyance roller pairs 1 and 2 may be configured to be incorporated into the same apparatus or unit, or the conveyance roller pairs 1 and 2 may be configured to be incorporated into the coupled pieces of apparatus or units.

The sheet conveyance control can be performed in the above-described manner as long as sheet scanner 3 is located on the downstream in the sheet conveyance direction of the conveyance roller pair 1 in which the increase or decrease of the sheet conveyance speed can be controlled. Therefore, even if the first embodiment is applied to a conveyance device with no conveyance roller pair 2 located near a sheet discharge port, the same effects can be obtained.

Although the conveyance roller pairs 1 and 2 are illustrated as the sheet conveyance member, the invention is not limited to the conveyance roller pair 1 and 2. For example, the same effects can be obtained even if the sheet conveyance member such as a belt is used instead of the roller.

Although the configuration in which the reading pixels of the photoelectric conversion device are arranged in the matrix shape is illustrated in the sheet scanner of the first embodiment, the invention is not limited to the configuration. For example, the sheet scanner in which the continuous reading pixels are arranged in one line or the sheet scanner in which the reading pixels are arranged in plural lines may be used.

Second Embodiment

Figure 4:
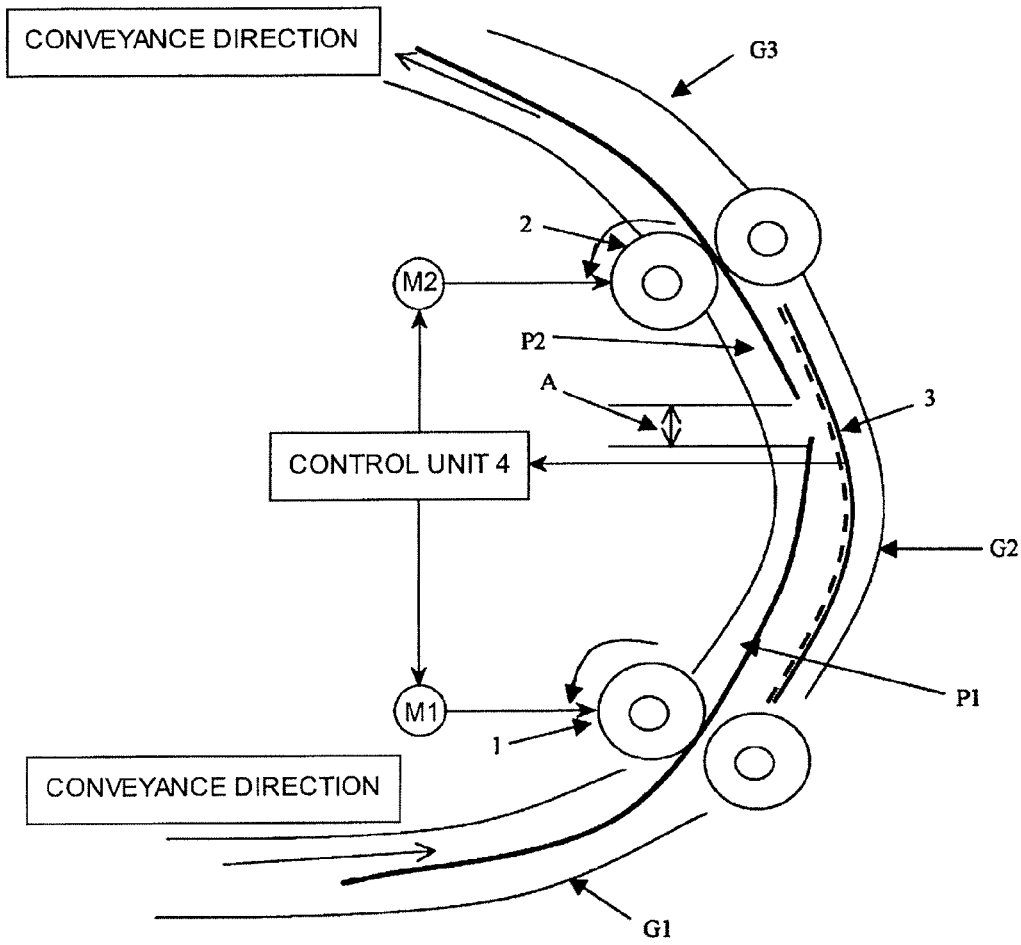
FIG. 4 is a sectional view illustrating a sheet conveyance device according to a second embodiment of the invention.
Figure 5:
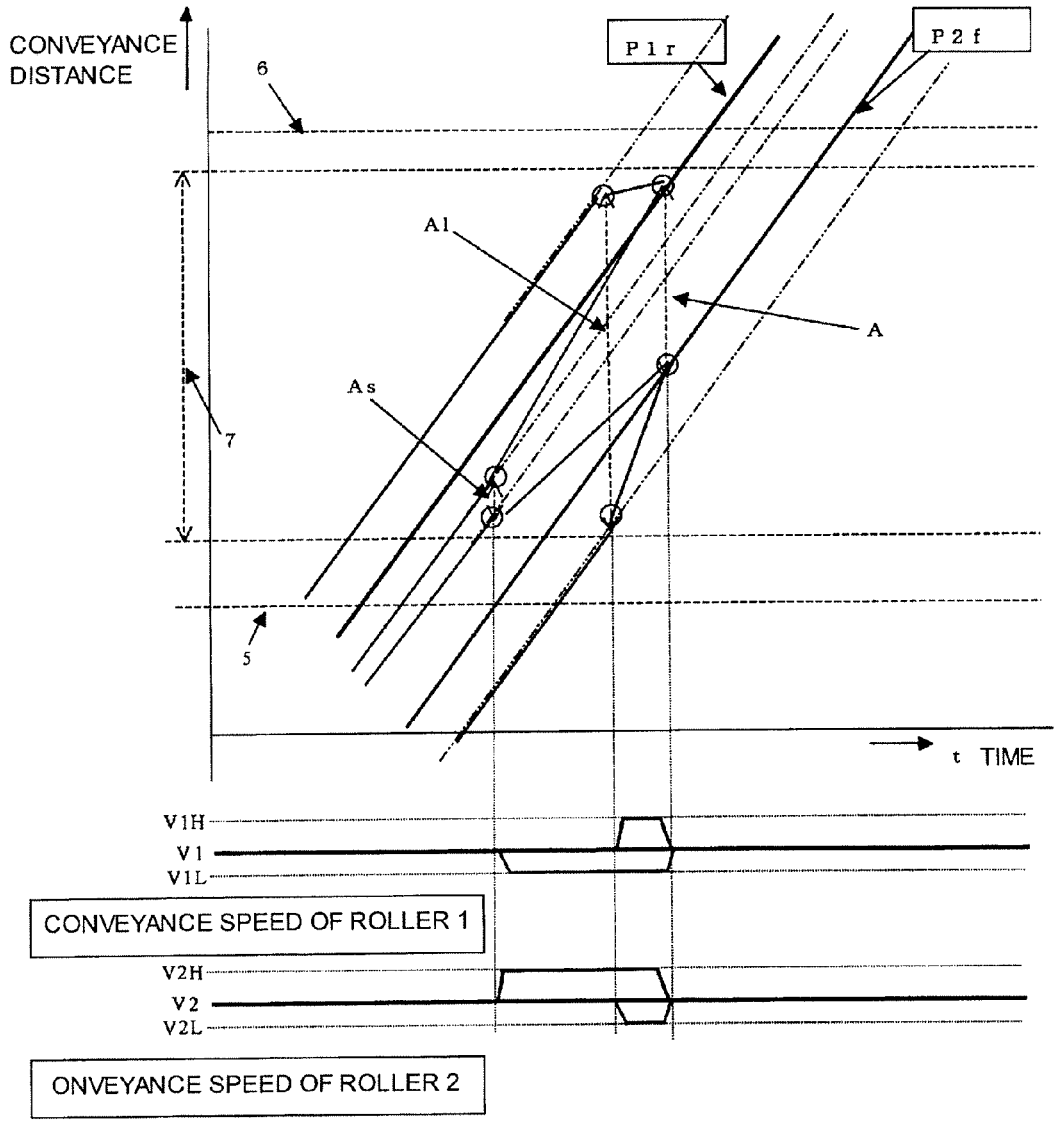
FIG. 5 is a view illustrating sheet conveyance control of the second embodiment.
Figure 6:
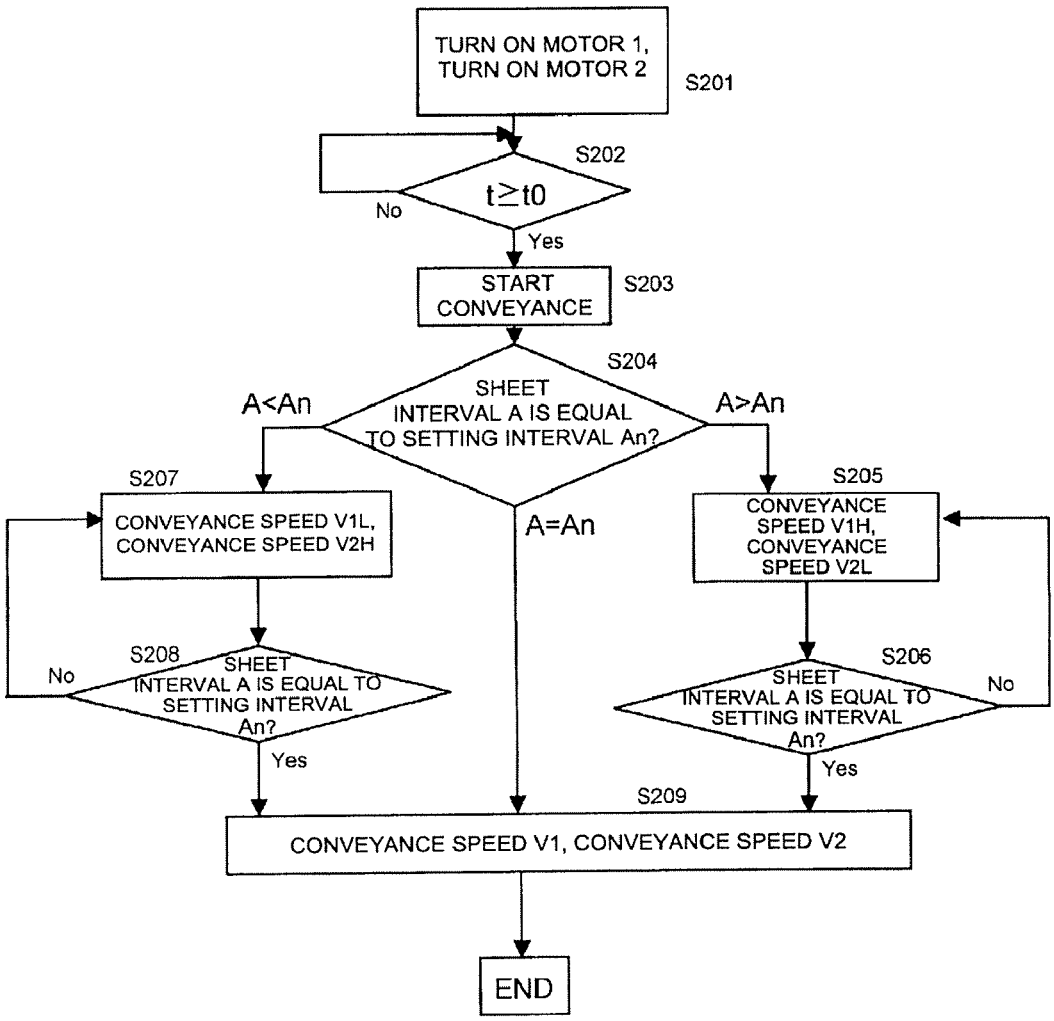
FIG. 6 is a flowchart illustrating control of the sheet conveyance device of the second embodiment.

A sheet conveyance device according to a second embodiment will be described in detail with reference to FIGS. 4 to 6. FIG. 4 is a sectional view showing a schematic configuration of a main part of the sheet conveyance device, FIG. 5 schematically shows conveyance control, and FIG. 6 is a flowchart showing the conveyance control.

The schematic configuration of the sheet conveyance device will be described with reference to FIG. 4, and then the conveyance control of the sheet conveyance device will be described.

Referring to FIG. 4, the sheet conveyance device includes the conveyance roller pairs 1 and 2 which are of the sheet conveyance member for conveying the sheet. The conveyance roller pair 1 is of the first sheet conveyance member, and the conveyance roller pair 2 which is of the second sheet conveyance member located on the downstream of the conveyance roller pair 1 in the sheet conveyance direction. The conveyance roller pair 1 is rotated by a first driving force from the motor M1, and the motor M1 is of the driving source which can increase and decrease the sheet conveyance speed. The conveyance roller pair 2 is rotated by a second driving force from a motor M2, and the motor M2 is of a driving source which can increase and decrease the sheet conveyance speed. The control unit 4 controls the drive of the motors M1 and M2. The sheet conveyance device also includes the conveyance guides G1, G2, and G3 which guide the sheet. The conveyance guides G1, G2, and G3 constitute the conveyance path through which the sheet conveyed by the conveyance roller pairs 1 and 2 is guided. In the second embodiment, the conveyance guides G1, G2, and G3 constitute the curved conveyance path. The flexible sheet scanner 3 which is of the above-described sheet detection unit is provided along the guide surface in the conveyance guide G2 between the conveyance roller pairs 1 and 2, which constitutes a part of the conveyance path. On the basis of information obtained from the sheet scanner 3, the control unit 4 controls the drives of the motors M1 and M2, i.e., the sheet conveyance speeds of the conveyance roller pairs 1 and 2 respectively.

The sheet detection performed by the sheet scanner will be described by illustrating the case in which the interval between the sheets is detected.

When the subsequent sheet P1 is conveyed by the conveyance roller pair 2 while the preceding sheet P2 is conveyed by the conveyance roller pair 1, the leading-end boundary between the rear-end boundary of the preceding sheet P1 and the leading-end boundary of the subsequent sheet P2 is detected by the sheet scanner 3 on the conveyance path G2. This enables the sheet interval A to be measured between the rear-end boundary of the preceding sheet P1 and the leading-end boundary of the subsequent sheet P2. The sheet scanner 3 can detect the presence or absence of the sheet to detect the leading-end position or rear-end position of the sheet.

The position of the conveyed sheet can continuously be detected, because the reading pixels 61 which are of the photoelectric conversion device are arranged in the matrix shape in the row direction (sheet conveyance direction) and the column direction (sheet width direction orthogonal to the sheet conveyance direction) in the sheet scanner 3. That is, the sheet scanner 3 can continuously trace the change in position of the conveyed sheet in an area where the sheet scanner 3 is provided. This enables the sheet interval A between the sheets P1 and P2 to be always measured while the sheets P1 and P2 are conveyed in the area where the sheet scanner 3 is provided.

Then, the sheet conveyance control based on the sheet detection information will be described with reference to FIGS. 5 and 6. In FIGS. 5 and 6, the letter An designates the sheet interval (hereinafter referred to as setting interval) which is previously set according to the conveyance conditions. In FIG. 5, the numeral P1*r* designates the rear-end boundary of the preceding sheet P1 and the numeral P2*f* is the leading-end boundary of the subsequent sheet. The numeral 5 designates the position of the conveyance roller pair 1, the numeral 6 designates the position of the conveyance roller pair 2, and the numeral 7 designates the detection area of the sheet scanner. When the sheets are continuously conveyed, the sheet scanner 3 detects the sheet interval A, and the sheet scanner 3 increases or decreases the sheet conveyance speeds of the conveyance roller pairs 1 and 2 based on the detection result such that the sheet interval A becomes the setting interval An.

In the actual conveyance state (S201 to S203), it is assumed that the sheet scanner 3 determines that the sheet interval A is the sheet interval As which is narrower than the setting interval An (S204). In this case, while the sheet scanner 3 measures the sheet interval A, the sheet scanner 3 decreases the sheet conveyance speed of the conveyance roller pair 1 such that the sheet conveyance speed becomes a conveyance speed V1L which is slower than the usual conveyance speed V1 (S205). At the same time, the sheet scanner 3 increases the sheet conveyance speed of the conveyance roller pair 2 such that the sheet conveyance speed becomes a conveyance speed V2H which is slower than a usual conveyance speed V2 (S205). Therefore, the sheet interval is widened. When the sheet interval A becomes the setting interval An (S206), the sheet conveyance speeds of the conveyance roller pairs 1 and 2 are returned to the usual conveyance speeds V1 and V2 respectively (S209), and the sheet interval A is kept at the setting interval An. A relationship of V1=V2 holds between the usual conveyance speeds V1 and V2 of the conveyance roller pairs 1 and 2.

On the other hand, in the actual conveyance state, it is assumed that the sheet scanner 3 determines that the sheet interval A is the sheet interval A1 which is wider than the setting interval An (2104). In this case, while the sheet scanner 3 measures the sheet interval A, the sheet scanner 3 increases the sheet conveyance speed of the conveyance roller pair 1 such that the sheet conveyance speed becomes a conveyance speed V1H which is faster than the usual conveyance speed V1 (S207). At the same time, the sheet scanner 3 decreases the sheet conveyance speed of the conveyance roller pair 2 such that the sheet conveyance speed becomes a conveyance speed V2L which is slower than the usual conveyance speed V2 (S207). Therefore, the sheet interval is narrowed. When the sheet interval A becomes the setting interval An (S208), the sheet conveyance speeds of the conveyance roller pairs 1 and 2 are returned to the usual conveyance speeds V1 and V2 respectively (S209), and the sheet interval A is kept at the setting interval An.

As described above, when the sheet interval A is not brought close to the setting interval An even if the sheet conveyance speed of the conveyance roller pair 2 is increased or decreased, the control unit 4 determines that conveyance failure is occurred.

Thus, according to the second embodiment, because the sheet scanner 3 in which the reading pixels 61 are arranged in the matrix shape is used as the sheet detection unit, the conveyed sheet can continuously be detected in the conveyance guide G2. The sheet scanner 3 is provided in the conveyance guide G2 which constitutes a part of the conveyance path. Accordingly, the sheet conveyance control is performed more finely based on the detection information. Because the sheet conveyance control is performed while the conveyed sheet is continuously detected, the need to set the sheet interval in which the margin is ensured to permit the fluctuation can be eliminated to decrease the sheet interval, which improves the productivity. Because the sheet interval is adjusted by increasing and decreasing the sheet conveyance speeds of the conveyance roller pairs 1 and 2, the productivity is further improved.

It is not always necessary to keep the conveyance speeds V1L, V1H, V2L, and V2H at constant conveyance speeds. Only one of the sheet conveyance speeds of the conveyance roller pairs 1 and 2 may be increased to keep the sheet interval at the setting interval. The setting interval An is the single setting value in the second embodiment. However, the setting interval An is not limited to the single setting value, but the setting interval An may have a certain range.

Although the configuration in which the reading pixels of the photoelectric conversion device are arranged in the matrix shape is illustrated in the sheet scanner of the first embodiment, the invention is not limited to the configuration. For example, the sheet scanner in which the continuous reading pixels are arranged in one line or the sheet scanner in which the reading pixels are arranged in plural lines may be used.

The conveyance roller pair 1 and 2 may be configured to be incorporated into the same apparatus or unit, or the conveyance roller pair 1 and 2 may be configured to be incorporated into the coupled pieces of apparatus or units.

Although the conveyance roller pairs 1 and 2 are illustrated as the sheet conveyance member, the invention is not limited to the conveyance roller pairs 1 and 2. For example, the same effects can be obtained even if the sheet conveyance member such as a belt is used instead of the roller.

Third Embodiment

Figure 7:
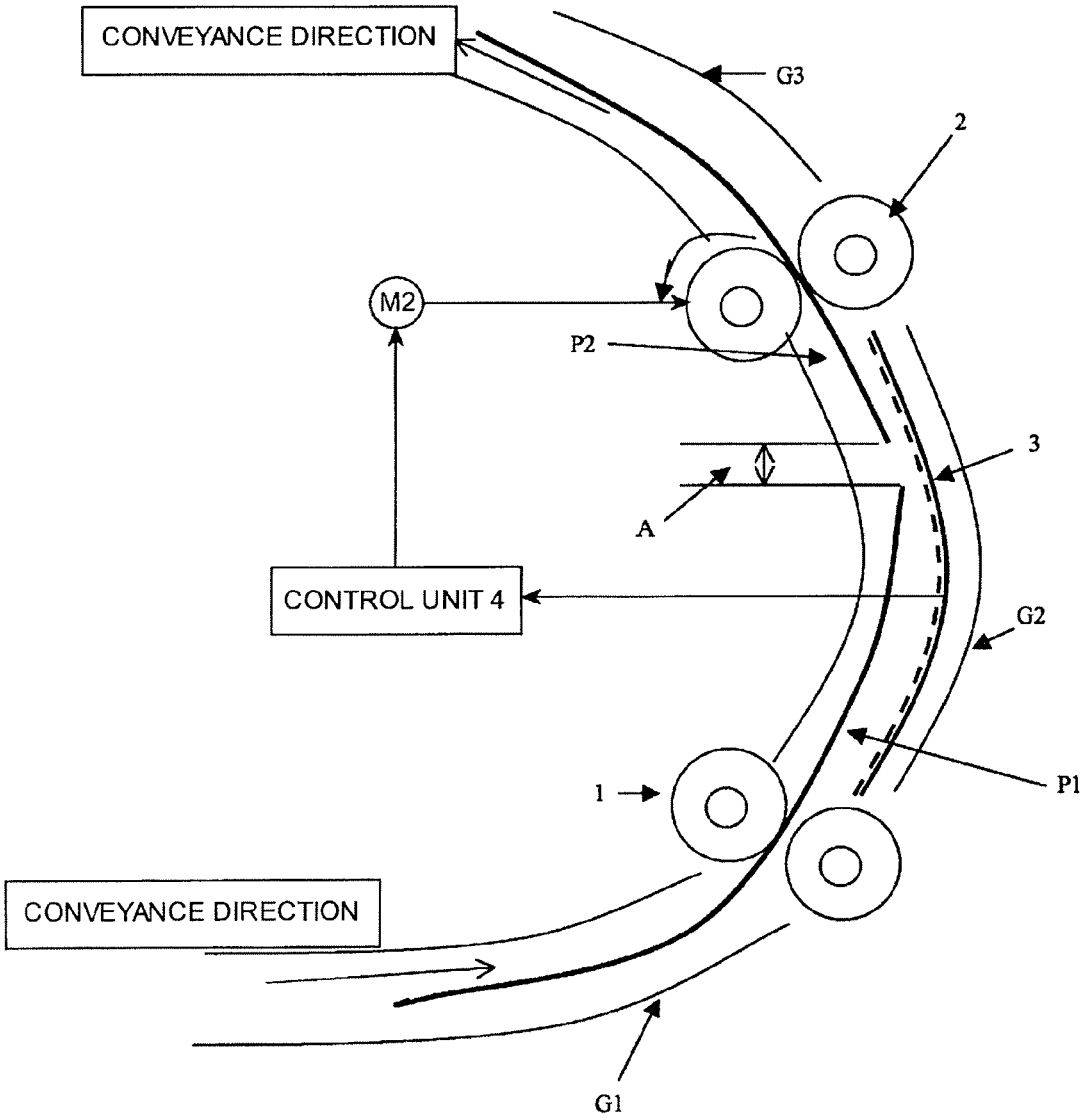
FIG. 7 is a sectional view illustrating a sheet conveyance device according to a third embodiment of the invention.
Figure 8:
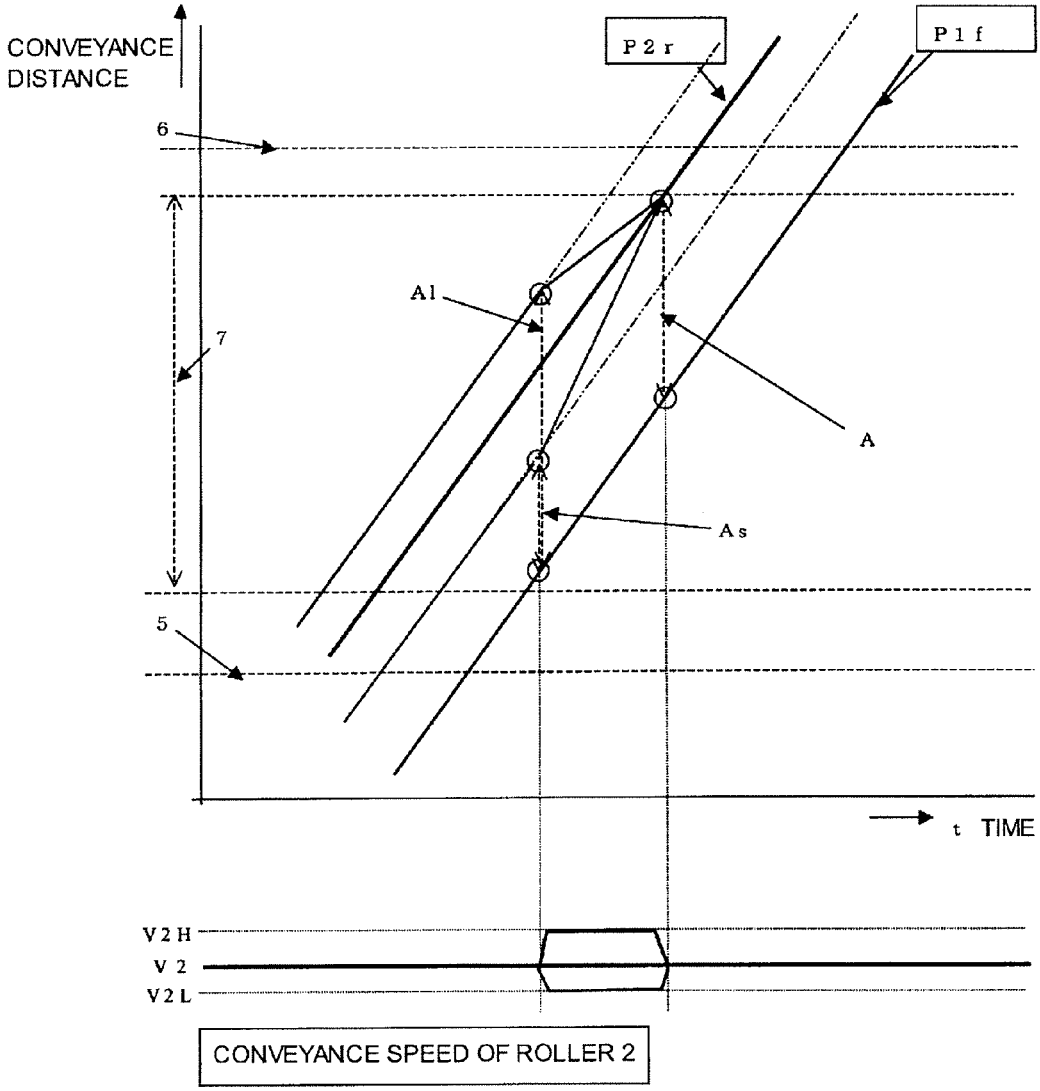
FIG. 8 is a view illustrating sheet conveyance control of the third embodiment.
Figure 9:
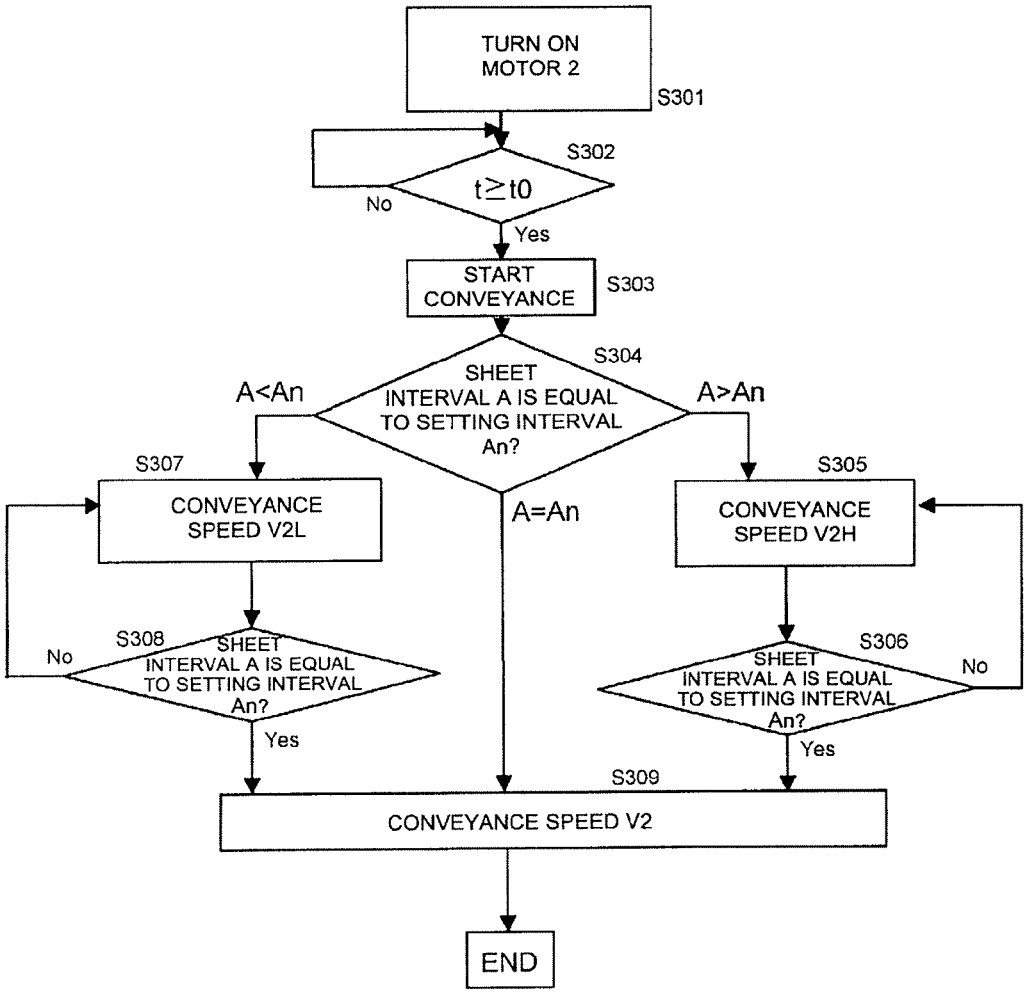
FIG. 9 is a flowchart illustrating control of the sheet conveyance device of the third embodiment.

A sheet conveyance device according to a third embodiment of the invention will be described in detail with reference to FIGS. 7 to 9. FIG. 7 is a sectional view showing a schematic configuration of a main part of the sheet conveyance device, FIG. 8 schematically shows conveyance control, and FIG. 9 is a flowchart showing the conveyance control.

The schematic configuration of the sheet conveyance device will be described with reference to FIG. 7, and then the conveyance control of the sheet conveyance device will be described.

Referring to FIG. 7, the sheet conveyance device includes the conveyance roller pairs 1 and 2 which are of the sheet conveyance member for conveying the sheet. The conveyance roller pair 1 is of the first sheet conveyance member, and the conveyance roller pair 2 which is of the second sheet conveyance member located on the downstream of the conveyance roller pair 1 in the sheet conveyance direction. The conveyance roller pair 1 is rotated by the driving force from the motor M2, and the motor M2 is of the driving source which can increase and decrease the sheet conveyance speed. The control unit 4 controls the drive of the motor M2. The sheet conveyance device also includes the conveyance guides G1, G2, and G3 which guide the sheet. The conveyance guides G1, G2, and G3 constitute the conveyance path through which the sheet conveyed by the conveyance roller pairs 1 and 2 is guided. In the third embodiment, the conveyance guides G1, G2, and G3 constitute the curved conveyance path. The flexible sheet scanner 3 which is of the above-described sheet detection unit is provided along the guide surface in the conveyance guide G2 between the conveyance roller pairs 1 and 2, which constitutes a part of the conveyance path. On the basis of information obtained from the sheet scanner 3, the control unit 4 controls the drive of the motor M2, i.e., the sheet conveyance speed of the conveyance roller pair 2.

The sheet detection performed by the sheet scanner will be described by illustrating the case in which the interval between the sheets is detected.

When the subsequent sheet P2 is conveyed by the conveyance roller pair 1 while the preceding sheet P1 is conveyed by the conveyance roller pair 2, the rear-end boundary of the preceding sheet P1 and the leading-end boundary of the subsequent sheet P2 is detected by the sheet scanner 3 on the conveyance path G2. This enables the sheet interval A to be measured between the rear-end boundary of the preceding sheet P1 and the leading-end boundary of the subsequent sheet P2. The sheet scanner 3 can detect the presence or absence of the sheet to detect the leading-end position or rear-end position of the sheet.

The position of the conveyed sheet can continuously be detected, because the reading pixels 61 which are of the photoelectric conversion device are arranged in the matrix shape in the row direction (sheet conveyance direction) and the column direction (sheet width direction orthogonal to the sheet conveyance direction) in the sheet scanner 3. That is, the sheet scanner 3 can continuously trace the change in position of the conveyed sheet in an area where the sheet scanner 3 is provided. This enables the sheet interval A between the sheets P1 and P2 to be always measured while the sheets P1 and P2 are conveyed in the area where the sheet scanner 3 is provided.

Then, the sheet conveyance control based on the sheet detection information will be described with reference to FIGS. 8 and 9. In FIGS. 8 and 9, the letter An designates the sheet interval (hereinafter referred to as setting interval) which is previously set according to the conveyance conditions. In FIG. 8, the numeral P1*r* designates the rear-end boundary of the preceding sheet P1 and the numeral P2*f* is the leading-end boundary of the subsequent sheet. The numeral 5 designates the position of the conveyance roller pair 1, the numeral 6 designates the position of the conveyance roller pair 2, and the numeral 7 designates the detection area of the sheet scanner. When the sheets are continuously conveyed, the sheet scanner 3 detects the sheet interval A, and the sheet scanner 3 increases or decreases the sheet conveyance speed of the conveyance roller pair 2 based on the detection result such that the sheet interval A becomes the setting interval An.

In the actual conveyance state (S301 to S303), it is assumed that the sheet scanner 3 determines that the sheet interval A is the sheet interval As which is narrower than the setting interval An (S304). In this case, while the sheet scanner 3 measures the sheet interval A, the sheet scanner 3 increases the sheet conveyance speed of the conveyance roller pair 2 such that the sheet conveyance speed becomes the conveyance speed V2H which is faster than the usual conveyance speed V2 (S305). Therefore, the sheet interval is widened. When the sheet interval A becomes the setting interval An (S306), the sheet conveyance speed of the conveyance roller pair 2 is returned to the usual conveyance speed V2 (S309), and the sheet interval A is kept at the setting interval An.

On the other hand, in the actual conveyance state (S301 to S303), it is assumed that the sheet scanner 3 determines that the sheet interval A is a sheet interval A1 which is wider than the setting interval An (S304). In this case, while the sheet scanner 3 measures the sheet interval A, the sheet scanner 3 decreases the sheet conveyance speed of the conveyance roller pair 2 such that the sheet conveyance speed becomes the conveyance speed V2L which is slower than the usual conveyance speed V2 (S307). Therefore, the sheet interval is narrowed. When the sheet interval A becomes the setting interval An (S308), the sheet conveyance speed of the conveyance roller pair 2 is returned to the usual conveyance speed V2 (S309), and the sheet interval A is kept at the setting interval An.

As described above, when the sheet interval A is not brought close to the setting interval An even if the sheet conveyance speeds of the conveyance roller pairs 1 and 2 are increased or decreased, the control unit 4 determines that conveyance failure is occurred.

Thus, according to the first embodiment, because the sheet scanner 3 in which the reading pixels 61 are arranged in the matrix shape is used as the sheet detection unit, the conveyed sheet can continuously be detected in the conveyance guide G2. The sheet scanner 3 is provided in the conveyance guide G2 which constitutes a part of the conveyance path. Accordingly, the sheet conveyance control is performed more finely based on the detection information. Because the sheet conveyance control is performed while the conveyed sheet is continuously detected, the need to set the sheet interval in which the margin is ensured to permit the fluctuation can be eliminated to decrease the sheet interval, which improves the productivity.

It is not always necessary to keep the conveyance speeds V2L and V2H at constant conveyance speeds. The setting interval An is the single setting value in the third embodiment. However, the setting interval An is not limited to the single setting value, but the setting interval An may have a certain range.

The conveyance roller pairs 1 and 2 may be configured to be incorporated into the same apparatus or unit, or the conveyance roller pairs 1 and 2 may be configured to be incorporated into the coupled pieces of apparatus or units.

Although the conveyance roller pairs 1 and 2 are illustrated as the sheet conveyance member, the invention is not limited to the conveyance roller pairs 1 and 2. For example, the same effects can be obtained even if the sheet conveyance member such as a belt is used instead of the roller.

Although the configuration in which the reading pixels of the photoelectric conversion device are arranged in the matrix shape is illustrated in the sheet scanner of the third embodiment, the invention is not limited to the configuration of the third embodiment. For example, the sheet scanner in which the continuous reading pixels are arranged in one line or the sheet scanner in which the reading pixels are arranged in plural lines may be used.

Fourth Embodiment

Figure 10:
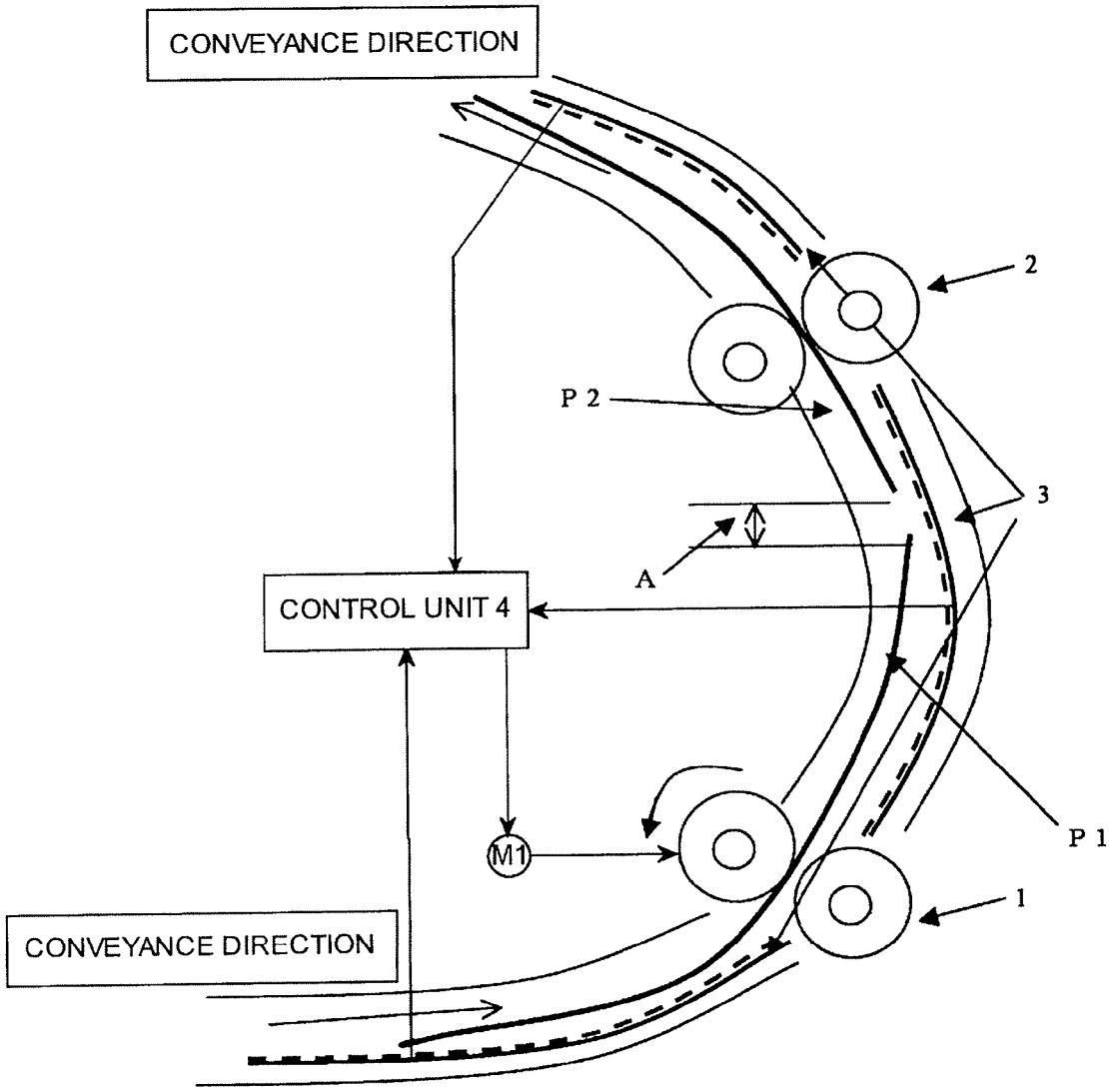
FIG. 10 is a sectional view illustrating a sheet conveyance device according to a fourth embodiment of the invention.

A sheet conveyance device according to a fourth embodiment of the invention will be described in detail with reference to FIG. 10. FIG. 10 is a sectional view showing a schematic configuration of a main part of the sheet conveyance device.

Referring to FIG. 10, the sheet conveyance device includes the conveyance roller pairs 1 and 2 which are of the sheet conveyance member for conveying the sheet. The conveyance roller pair 1 is of the first sheet conveyance member, and the conveyance roller pair 2 which is of the second sheet conveyance member located on a downstream of the conveyance roller pair 1 in the sheet conveyance direction. The conveyance roller pair 1 is rotated by the driving force from the motor M1, and the motor M1 is of the driving source which can increase and decrease a sheet conveyance speed. The control unit 4 controls the drive of the motor M1. The sheet conveyance device also includes the conveyance guides G1, G2, and G3 which guide the sheet. The conveyance guides G1, G2, and G3 constitute the conveyance path through which the sheet conveyed by the conveyance roller pairs 1 and 2 is guided. In the fourth embodiment, the conveyance guides G1, G2, and G3 constitute the curved conveyance path. The flexible sheet scanner 3 which is of the above-described sheet detection unit is provided along the guide surface in the conveyance guides G1, G2, and G3 which constitute the conveyance path. That is, the sheet scanner is provided in the whole area of the conveyance path. On the basis of information obtained from the sheet scanner 3, the control unit 4 controls the drive of the motor M1, i.e., the sheet conveyance speed of the conveyance roller pair 1.

Because the sheet scanner 3 is provided in the whole area of the conveyance path, not only the position of the conveyed sheet can continuously be detected, but also the change in position of the sheet can be traced in the whole area of the conveyance path.

In the sheet conveyance control for adjusting the sheet interval between the sheets P1 and P2, the sheet conveyance speed of the conveyance roller pair 1 may be increased and decreased based on the detection information from the sheet scanner 3 provided in the conveyance path G2. Alternatively, the sheet conveyance speed of the conveyance roller pair 1 may be increased and decreased based on the detection information from the sheet scanner 3 provided in the conveyance path G1.

Although the sheet conveyance control is described in the above embodiments, the sheet conveyance control is not limited to the sheet interval adjustment. For example, the leading-end position and rear-end position of the one sheet are detected by the sheet scanner, and the actual sheet conveyance speed is measured based on the detection information. The actual sheet conveyance speed detected by the sheet scanner is compared to the conveyance speed of the conveyance roller pair controlled by the drive of the motor. When the shift is generated, it is determined that conveyance failure is occurred. Then, the conveyance speed of the conveyance roller pair is increased and decreased by the drive control of the motor such that the conveyance speed becomes the actual sheet conveyance speed. When the actual sheet conveyance speed is not changed or delayed even if the conveyance speed of the conveyance roller pair is increased, it is determined that the conveyance roller slips with respect to the sheet. In such cases, it is determined that the roller is worn, and a user is notified that the roller exchange is required.

The leading-end position and rear-end position of the one sheet are simultaneously detected to measure a length from the leading end and the rear end by the sheet scanner, and the detected sheet length is compared to the normal length of the actually used sheet. When a difference exists between the detected sheet length and the normal length of the actually used sheet, it is determined that conveyance failure is occurred. In such cases, it is determined that the plural sheets are conveyed while overlapping each other, and a user is notified of the overlapped sheet conveyance.

In the case where the sheet is continuously detected, when the sheet is stopped (one of the sheet ends is stopped or the whole of the sheet is stopped) even if the motor for rotating the conveyance roller pair is stopped, it is determined that conveyance failure is occurred. In such cases, it is determined that the sheet is jammed, and a user is notified of the jammed sheet.

In the sheet conveyance control for adjusting the sheet interval, the conveyance speed of the conveyance roller pair is increased and decreased only for a predetermined time. When the setting interval cannot be ensured even if the conveyance speed is increased and decreased for the predetermined time, it is determined that conveyance failure is occurred. In such cases, a user is also notified of the conveyance failure.

The sheet conveyance control is not limited to the case in which the sheet scanner is provided in the whole area of the conveyance path, but the sheet conveyance control can be performed even in the case in which the sheet scanner is provided in a predetermined area of the conveyance path. For the predetermined area of the conveyance path, the sheet scanner may appropriately be provided in an area wider than the sheet having the usable maximum size and the like as necessary in addition to the area described in the above embodiments.

The sheet conveyance control of the fourth embodiment may be used in conjunction with the sheet conveyance control of the above embodiment.

The conveyance roller pairs 1 and 2 may be configured to be incorporated into the same apparatus or unit, or the conveyance roller pairs 1 and 2 may be configured to be incorporated into the coupled pieces of apparatus or units.

Although the conveyance roller pairs 1 and 2 are illustrated as the sheet conveyance member, the invention is not limited to the conveyance roller pairs 1 and 2. For example, the same effects can be obtained even if the sheet conveyance member such as a belt is used instead of the roller.

Although the configuration in which the reading pixels of the photoelectric conversion device are arranged in the matrix shape is illustrated in the sheet scanner of the third embodiment, the invention is not limited to the configuration of the third embodiment. For example, the sheet scanner in which the continuous reading pixels are arranged in one line or the sheet scanner in which the reading pixels are arranged in plural lines may be used.

Other Embodiments

The image forming apparatus is not specifically illustrated in the above embodiments. Examples of the image forming apparatus include a scanner, a printer, a copying machine, a facsimile, and a multifunction peripheral in which these functions are combined. The above effects can be obtained by applying the invention to the sheet conveyance device used in these pieces of image forming apparatus.

Examples of the sheet conveyance device used in the image forming apparatus include a sheet conveyance device which is detachably attachable to the image forming apparatus and a sheet conveyance device which is integral with the image forming apparatus, and the same effects can be obtained by applying the invention to the sheet conveyance devices. In addition to the image forming apparatus, the invention may be applied to the sheet conveyance device in the sheet processing apparatus which is used while connected to the image forming apparatus.

The sheet conveyance device may be not only the sheet conveyance device which conveys the sheet such as the recording paper of the recording target but also the sheet conveyance device which conveys the sheet such as the original of the reading target to an image reading portion, and the effects can be obtained even if the invention is applied to the sheet conveyance device.

This application claims the benefit of priority from the prior Japanese Patent Application No. 2006-214665 filed on Aug. 7, 2006 the entire contents of which are incorporated by reference herein.

What is claimed is:

1. A sheet conveyance device comprising:

a sheet conveyance member which conveys a sheet;

a guide member which guides the sheet conveyed by the sheet conveyance member; and sheet detection unit which detects the sheet guided by the guide member, wherein a sheet conveyance speed of the sheet conveyed by the sheet conveyance member is controlled based on information from the sheet detection unit, wherein the sheet detection unit is a sheet scanner having an optical sensor layer in which photoelectric conversion devices formed by combinations of organic transistors and organic photodiodes are continuously arranged in a matrix shape, and the sheet scanner is provided in the guide member in order to continuously detect the sheet conveyed by the sheet conveyance member, and wherein the sheet scanner is provided in the guide member located on a downstream of the sheet conveyance member in a sheet conveyance direction, and the sheet conveyance speed of the sheet conveyance member located on an upstream of the guide member is controlled based on information from the sheet scanner provided in the guide member.

2. The sheet conveyance device according to claim 1, wherein, while a sheet interval between a leading end of a second sheet conveyed by the conveyance member located on the upstream of the sheet scanner and a rear end of a first sheet preceding the second sheet is continuously detected by the sheet scanner, the detected sheet interval is compared to a previously set setting interval between the rear end of the first sheet and the leading end of the second sheet, the conveyance speed of the second sheet is increased by the sheet conveyance member such that the detected sheet interval is brought close to the setting interval when the detected sheet interval is larger than the setting interval, and the conveyance speed of the second sheet is decreased by the sheet conveyance member such that the detected sheet interval is brought close to the setting interval when the detected sheet interval is smaller than the setting interval.

3. The sheet conveyance device according to claim 2, wherein the sheet conveyance speed of the sheet conveyance member is returned to the initial conveyance speed before increasing or decreasing the conveyance speed, when the detected sheet interval is equalized to the setting interval.

4. The sheet conveyance device according to claim 2, wherein it is determined as conveyance failure, when the detected sheet interval is not brought close to the setting interval even if the sheet conveyance speed of the sheet conveyance member is increased or decreased based on the comparison of the detected sheet interval and the setting interval.

* * * * *